US005428197A

United States Patent [19]

McCurry et al.

[11] Patent Number: 5,428,197

[45] Date of Patent: Jun. 27, 1995

[54] ELECTRIC TOOL ACTUATOR SWITCH

[75] Inventors: Ronald C. McCurry, West Union; Robert E. McCracken, Easley; James A. Keith, Jr., Pickens, all of S.C.

[73] Assignee: Ryobi Motor Products Corp., Easley, S.C.

[21] Appl. No.: 69,615

[22] Filed: Jun. 1, 1993

[51] Int. Cl.[6] ..... H01H 9/06

[52] U.S. Cl. ..... 200/332.2; 200/332; 200/302.1; 200/318; 200/302.2

[58] Field of Search ..... 200/332.2, 332, 332.1, 200/301, 303.1, 302.2, 573, 318, 522, 318.1, 318.2, 321

[56] References Cited

U.S. PATENT DOCUMENTS

| | | | |
|---|---|---|---|
| 2,525,839 | 10/1950 | Sparklin | 173/170 |
| 3,309,484 | 3/1967 | Frenzel | 200/522 |
| 3,383,943 | 5/1968 | Piber | 74/529 |
| 4,241,297 | 12/1980 | Piber et al. | 318/17 |
| 4,276,461 | 6/1981 | Piber | 200/329 |
| 4,506,198 | 3/1985 | Savas | 388/838 |
| 4,572,997 | 2/1986 | Yamanobe et al. | 388/840 |
| 4,649,245 | 3/1987 | Lessig, III et al. | 200/522 |
| 5,136,130 | 8/1992 | Daly | 200/318.1 |

FOREIGN PATENT DOCUMENTS

| | | | |
|---|---|---|---|
| 2856686 | 5/1979 | Germany | 200/332.1 |
| 866535 | 4/1961 | United Kingdom | 200/302.2 |

*Primary Examiner*—Renee S. Luebke
*Assistant Examiner*—David J. Walczak
*Attorney, Agent, or Firm*—Brooks & Kushman

[57] ABSTRACT

An actuator switch (25) for an electrical power tool (10), having a housing (16) and an electric motor supported by the housing (16) for operatively driving a work implement, is provided. The actuator switch (25) includes a trigger (22) which cooperates with the housing (16) and is shiftably operable by the user between "on" and "off" positions. A power switch assembly (26) is oriented within the tool housing (16) adjacent the trigger (22) for actuation thereby. The power switch assembly includes a body (28) defining an internal cavity (30) with an aperture (32) extending therethrough. An electrical switch (34) is located within the switch assembly (26) and is electrically connected to the electric motor. A plunger (42) extends through the body aperture (32) to enable the trigger (22) to activate the electrical switch (34). An elastomeric pad (44) is operatively positioned between the plunger (42) and the trigger (22). The pad (44) is of sufficient size and thickness to sealingly engage the switch body (28) and to cover the aperture (32) when the trigger (22) is shifted to the "on" position to maintain the power tool energized during normal operation, in spite of tool vibration, and to prevent dirt and debris from entering the cavity (30) of the actuator switch body (28).

16 Claims, 2 Drawing Sheets

ELECTRIC TOOL ACTUATOR SWITCH

TECHNICAL FIELD

This invention relates to actuator switches for electric power tools, and more particularly, to actuator switches for portable hand held power tools operating in a debris ladened environment.

BACKGROUND ART

Portable hand held power tools typically have an on/off switch for regulating the operation of an electric motor. The actuator switch is normally located within the tool housing and is remotely operable by a user via a trigger or a slide switch. In instances where a trigger is used which is normally biased to an "off" position, the operator must maintain the trigger in a depressed position for the power tool to be energized. If the operator wants to run the power tool for an extended period of time, the trigger can be latched to an "on" position as is typically done in conventional electric drills and routers. Examples of typical actuator switches are illustrated in U.S. Pat. Nos. 3,309,484 and 4,572,997.

DISCLOSURE OF THE INVENTION

An object of the present invention is to provide an efficient actuator switch which will prevent dirt and debris from entering the region of the power tool containing the electrical switch including contacts.

Another object of the present invention is to prevent the user from inadvertently damaging an electrical switch by exerting excessive force on the tool trigger.

Yet another object of the present invention is to maintain the power tool in the "on" position when the trigger is appropriately latched in spite of routine power tool vibration.

Still yet another object of the present invention is to produce a reliable and efficient actuator switch which is capable of being produced using conventional tolerances associated with high speed injection molding processes.

Accordingly, an actuator switch for an electrical power tool, having a housing and electrical motor supported by the housing for operatively driving a work implement, is provided. The actuator switch includes a trigger which cooperates with the housing and is shiftably operable by the user between "on" and "off" positions. A power switch assembly is oriented within the tool housing adjacent the trigger for actuation thereby. The power switch assembly includes a body defining an internal cavity with an aperture extending therethrough. An electrical switch is located within the switch assembly and is electrically connected to the electric motor. A plunger extends through the body aperture to enable the trigger to activate the electrical switch. An elastomeric pad is operatively positioned between the plunger and the trigger. The pad is of sufficient size and thickness to sealingly engage the switch body and to cover the aperture when the trigger is shifted to the "on" position to maintain the power tool energized during normal operation, in spite of tool vibration, and to prevent dirt and debris from entering the cavity of the actuator switch body.

These and other objects, features and advantages of the present invention will be apparent upon review of the accompanying description of the preferred embodiments of the invention and the drawings.

BEST MODES FOR CARRYING OUT THE INVENTION

Figure 1:
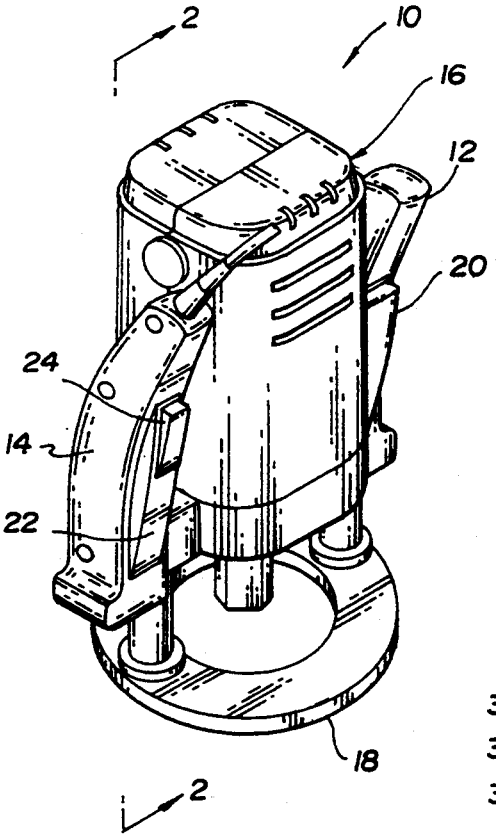
FIG. 1 is a perspective view of a plunge router embodying an actuator switch of the present invention.
Figure 2:
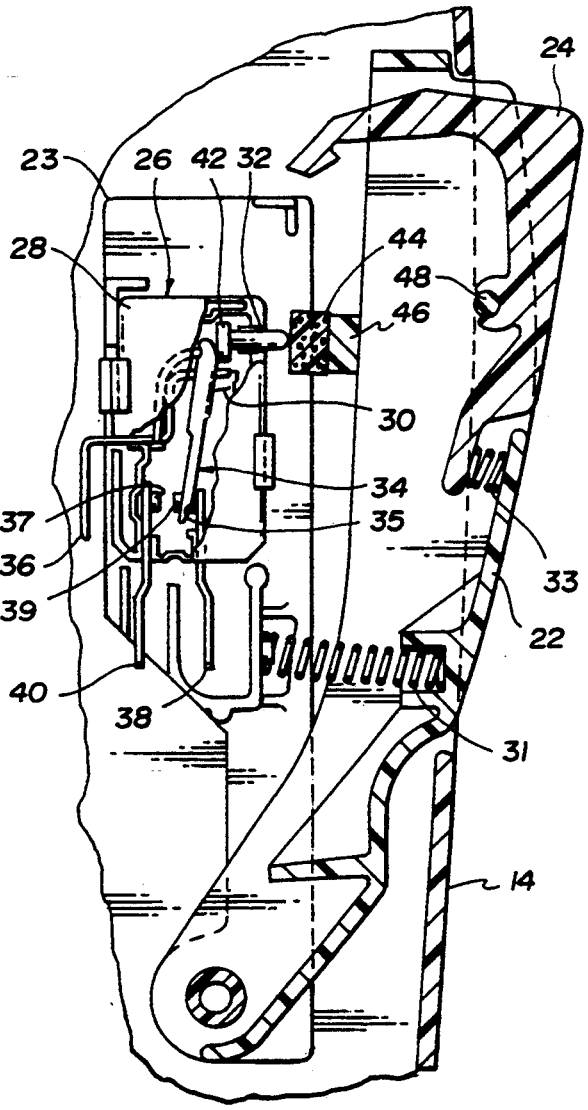
FIG. 2 is an enlarged cross-sectional view, taken along line 2—2 of FIG. 1, illustrating the actuator switch.

The preferred embodiment of the invention is shown in FIGS. 1–5. A power tool or router 10, illustrated in FIG. 1, is of a modern plunge router design having a pair of handles 12 and 14 attached to opposite sides of a router motor housing assembly 16. The operator of router 10, without removing his/her hands from handles 12 and 14, can raise and lower the motor housing assembly 16 relative to an annular base 18. The motor housing assembly 16 may be locked at various heights utilizing a locking lever 20 on handle 12. Concurrently, the user can turn the router 10 "on" and "off" utilizing a trigger 22 to actuate an electrical motor 11. If router 10 is to be run for an extended period of time, a latching lever 24 can be engaged with a switch mounting frame 23 to maintain trigger 22 in the "on" state or position. Switch mounting frame 23 is mounted within handle 14 as shown in FIG. 2.

An actuator switch 25 comprises trigger 22 and a power switch assembly 26. The internal structure of a power switch assembly 26 is best illustrated in FIG. 2 which shows trigger 22 in an "off" position. Trigger 22 is pivotably attached to switch mounting frame 23. Power switch assembly 26 includes a body 28 defining an internal cavity 30 with an aperture 32 extending through body 28 into internal cavity 30. A spring 31 extends between body 28 and trigger 22 to bias trigger 22 to the "off" position. Similarly, a spring 33 is interposed between trigger 22 and latching lever 24 to keep latching lever 24 releasably engaged with switch mounting frame 23.

An electrical switch 34 is located within the body internal cavity 30 and is provided with at least two electrical conductors 36 and 40 which are operatively connected and disconnected to regulate the power to a tool electric motor (not shown). Electrical conductors 36 and 40 extend from the electrical switch 34 to a location external of the switch body 28. In this preferred embodiment, electrical switch 34 is also electrically connectible to a third electrical conductor 38 for reasons which are immaterial to understanding and practicing of the present invention.

Figure 4:
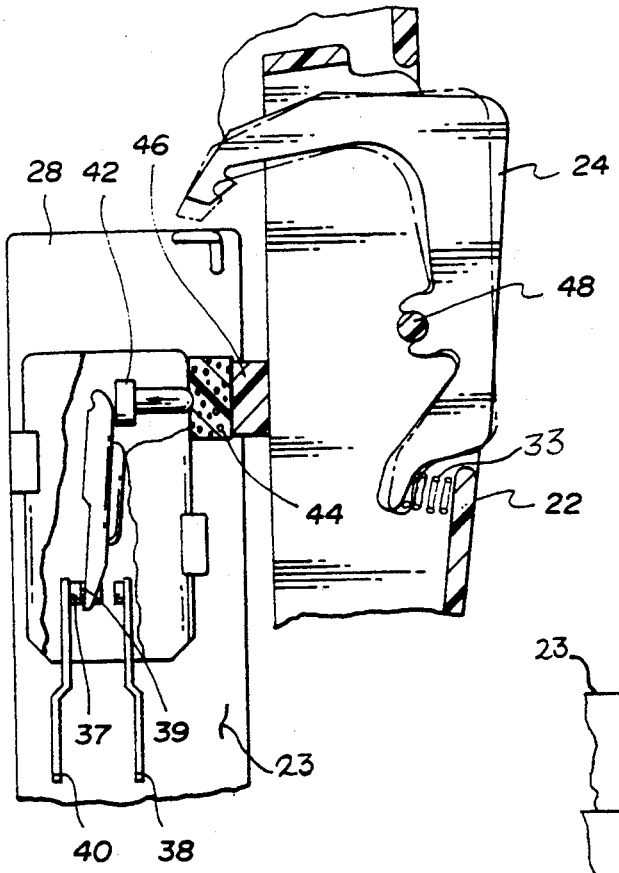
FIG. 4 is a cross-sectional side view illustrating the trigger in an "on" but unlocked position.

Contacts 35 and 37 are provided at the ends of conductors 38 and 40 to interface, respectively, with switch 34 and a third contact 39 located on switch 34. Conductor 36 is electrically connected to conductor 38 when electrical switch 34 is in the "off" position as illustrated in FIG. 2 and connected to conductor 40 when the switch is in the "on" position as depicted in FIG. 4.

A plunger 42 extends through aperture 32 and serves to actuate electrical switch 34. Plunger 42 is shiftable between an extended position, illustrated in FIG. 2, when the power tool or router 10 is "off" and a depressed position, illustrated in FIG. 4, when the tool 10 is energized. In the depressed position, the plunger 42 is substantially flush with switch body 28.

An elastomeric foam pad 44 is bonded to a pad support 46 on trigger 22 and serves to operatively actuate the plunger 42 when trigger 22 is depressed. Foam pad 44 is preferably formed of a polyurethane foam having a thickness falling within the range of 0.050 to 0.200 inches. Preferably, foam pad 44 has a density of between 18 and 22 pounds per cubic foot. As can be seen in FIG. 2, foam pad 44 is sized to engage the switch body 28 in a region completely surrounding the aperture 32 when the trigger 22 is shifted to the "on" position. Elastomeric foam pad 44 has sufficient contact area engaging switch body 28 to prevent trigger 22 from exerting force on plunger 42 sufficient to damage electrical switch 34.

Figure 3:
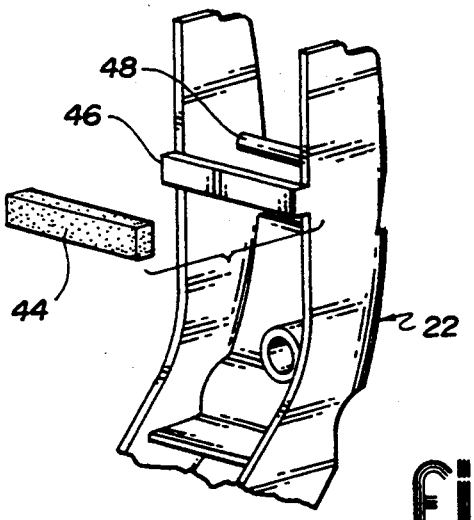
FIG. 3 is a fragmentary perspective view illustrating an elastomeric foam pad and a portion of a trigger.

The orientation of foam pad 44 relative to pad support 46 is best illustrated in FIG. 3. Pad support 46 is integrally molded into trigger 22 which is an injection molding. Pad 44 is affixed to pad support 46 utilizing a conventional adhesive.

When power tool or router 10 is operating, dust and debris is produced which is blown and swirled and becomes air born. By sealing aperture 32 with an elastomeric foam pad 44 during operation of power tool 10, the dust and debris is prevented from entering cavity 30 and coating contacts 35, 37 and 39.

A shaft 48 is also integrally formed during the molding of trigger 22. Latching lever 24 snaps on to shaft 48 and is thereafter free to pivot through a limited arcuate range.

FIG. 4 illustrates trigger 22 shifted to the "on" position. Note, elastomeric foam pad 44 sealingly cooperates with body 28 while plunger 42 is depressed.

Figure 5:
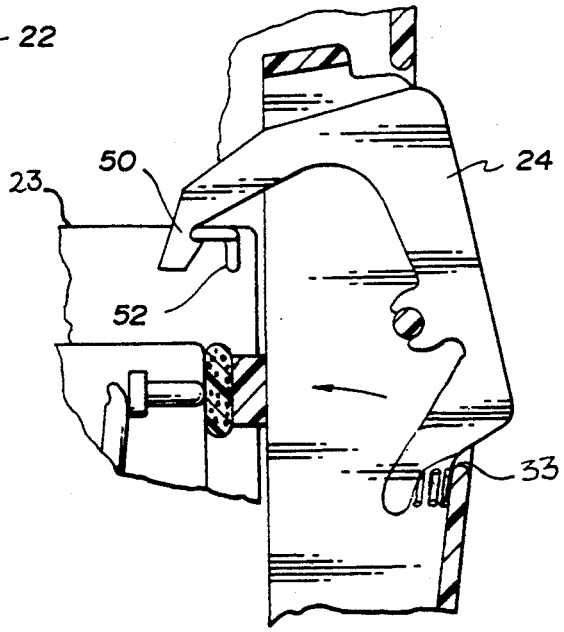
FIG. 5 is a cross-sectional side elevational view illustrating the trigger in an "on" and also locked position.

As illustrated in FIG. 5, latching lever 24 may be locked and thereby maintains trigger 22 in the "on" position. Latching lever 24 is provided with a hook portion 50 which can be latched over a cross member 52 of switch mounting frame 23 to maintain trigger 22 in the locked "on" position. When trigger 22 is locked "on" as illustrated in FIG. 5, foam pad 44 maintains adequate force on plunger 42 to keep the electric switch contacts 37 and 39 engaged. Due to the elastic nature of foam pad 44, foam pad 44 serves to absorb and dampen vibrations thereby keeping contacts 37 and 39 closed despite normal tool vibration. Elastomeric pad 44 also accommodates normal dimensional variations of components as a result of production which occur in the injection molding process of the components of power tool 10. This enables the latching lever 24 to be formed using a conventional high speed injection molding process.

Figure 6:
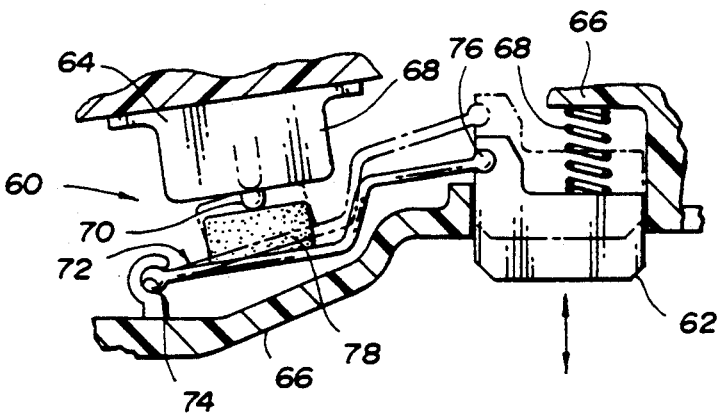
FIG. 6 is an alternative embodiment of the invention utilizing a remotely mounted trigger and an intermediate link.

An alternative embodiment of an actuator switch assembly 60 made in accordance with the present invention is illustrated in FIG. 6. Actuator switch assembly 60 is located in handle 14 of a power tool 10 such as a drill motor or router 10 where, due to space limitations, it is advantageous to orient a trigger 62 remotely from a power switch assembly 64.

A housing 66 of handle 14 supports trigger 62 which is capable of translating relative thereto between an "on" position, shown in phantom outline, and an "off" position as illustrated. Trigger 62 is biased to the "off" position by a spring 68. Switch assembly 64 is similar to switch assembly 26 described with reference to the first embodiment of the invention. Switch assembly 64 again includes electrical contacts (not shown) located inside an internal cavity formed in a switch body 68. A plunger 70 projects from the switch assembly 64 and is illustrated in the "off" position. Plunger 70 is depressed into the switch assembly 64 when in the "on" position as shown in phantom outline.

A link 72 is provided which extends between housing 66 and trigger 62. Link 72 has a first end 74, pivotably connected to housing 66, and an opposed second end 76, pivotably connected to trigger 62. Link 72 has a central region extending between first and second ends 74 and 76 for supporting an elastomeric pad 78. Elastomeric pad 78, like elastomeric pad 42 described with reference to the first embodiment, is sized to sealingly engage the body 68 of power switch assembly 64 to prevent dirt and debris from entering switch assembly 68. Link 72 serves to operatively connect the trigger 62 to plunger 70 via elastomeric pad 78 which is interposed between the link 72 and switch assembly 64. When trigger 62 is depressed, second end 76 pivots about first end 74 to thereby translate pad 78 and depress plunger 70 energizing the tool motor.

While the best modes for carrying out the invention have been described in detail, those familiar with the art to which this invention relates will recognize various alternative designs and embodiments for practicing the invention as defined by the following claims.

What is claimed:

1. An electric power tool comprising:

a housing;

an electric motor supported by the housing and having a rotary armature shaft for drivingly cooperating with a work implement;

a trigger cooperating with the housing and shiftable by a user of the tool between an on position and an off position;

a power switch assembly having a body defining an internal cavity with an aperture extending through the body into the internal cavity, an electrical switch located within the cavity, at least two electrical conductors connected to the switch and extending through the body to a location external thereto to regulate the operation of the electric motor, and a plunger extending through the aperture to actuate the electrical switch, the plunger shiftable between a depressed position in which the electric motor is energized and an extended position in which the electric motor is de-energized; and an elastomeric pad operatively positioned between the plunger and the trigger and bonded to the trigger, said pad sealingly covering the aperture and having sufficient contact area flushly engaging the switch body to limit the depression of the plunger preventing damage to the electrical switch when the trigger is depressed.

2. The electric power tool of claim 1 further comprising a trigger latch cooperating with the trigger and a member, which is secured relative to the housing, for releasably locking the trigger in the on position thereby providing a continued exertion of force on the trigger by the latch, the elastomeric pad sealingly cooperating with the switch body and maintaining the plunger in the depressed state once the latch is engaged with the housing.

3. The electric power tool of claim 1 wherein the elastomeric pad is formed of a polyurethane foam material.

4. The electric power tool of claim 3 wherein the elastomeric pad has a thickness of between 0.050 and 0.200 inches.

5. The electric power tool of claim 3 wherein the elastomeric pad has a density falling between 18 and 22 pounds per cubic foot.

6. The electric power tool of claim 1 wherein the plunger is substantially flush with the switch body when the plunger is in the depressed state.

7. The electric power tool of claim 1 further comprising a link cooperating with the housing and the trigger and shiftable relative to the switch assembly in response to trigger movement wherein the elastomeric pad is affixed to the link enabling the trigger to operatively actuate the plunger while the trigger is oriented remotely therefrom.

8. The electric power tool of claim 7 wherein the link has one end pivotably connected to the housing and an opposite end pivotably connected to the trigger, the link having a central region therebetween supporting the elastomeric pad.

9. An actuator switch for an electric power tool which has a housing and an electric motor supported by the housing for operatively driving a work implement, said actuator switch comprising:

a trigger cooperating with the housing and shiftably operable by a user between an on position and an off position;

a power switch assembly having a body defining an internal cavity with an aperture extending through the body, a switch located within the cavity and connected to a pair of conductors extending external to the cavity for controlling the operation of the electric motor, and a plunger extending through the aperture in the body for actuating the electrical switch; and an elastomeric pad operatively positioned between the plunger and the trigger and bonded to the trigger, said pad sealingly covering the aperture and having sufficient contact area flushly engaging the switch body to limit the depression of the plunger preventing damage to the electrical switch when the trigger is depressed.

10. The actuator switch of claim 9 further comprising a trigger latch cooperating with the trigger and the housing for releasably locking the trigger in the on position, the continued exertion of force on the trigger by the latch causing the elastomeric pad to sealingly cooperate with the switch body and maintain the plunger in the depressed state once the latch is engaged with the housing.

11. The actuator switch of claim 9 wherein the elastomeric pad is formed of polyurethane foam material.

12. The actuator switch of claim 11 wherein the foam pad has thickness of between 0.050 and 0.200 inches.

13. The actuator switch of claim 11 wherein the elastomeric pad has a density falling between 18 and 22 pounds per cubic foot.

14. The actuator switch of claim 9 wherein the plunger is substantially flush with the switch body when in the depressed state.

15. The actuator switch of claim 9 further comprising a link cooperating with the housing and the trigger and shiftable relative to the switch assembly in response to trigger movement wherein said elastomeric pad is affixed to the link enabling the trigger to operatively actuate the plunger while being oriented remotely therefrom.

16. The actuator switch of claim 15 wherein the link has one end pivotably connected to the housing and an opposite end pivotably connected to the trigger, the link having a central region therebetween supporting the elastomeric pad.

* * * * *